US006799644B2

(12) United States Patent
Hoop et al.

(10) Patent No.: US 6,799,644 B2
(45) Date of Patent: Oct. 5, 2004

(54) PNEUMATIC PERCUSSIVE MECHANISM

(75) Inventors: Alexander Hoop, Schaan (LI); Christoph Würsch, Werdenberg (CH); Hanspeter Schad, Grabs (CH); Hans Boeni, Buchs/SG (CH); Albert Binder, Buchs (CH)

(73) Assignee: Hilti Aktiengesellschaft, Schaan (LI)

( * ) Notice: Subject to any disclaimer, the term of this patent is extended or adjusted under 35 U.S.C. 154(b) by 0 days.

(21) Appl. No.: 10/427,346

(22) Filed: May 1, 2003

(65) Prior Publication Data

US 2003/0205393 A1 Nov. 6, 2003

(30) Foreign Application Priority Data

May 3, 2002 (DE) ..... 102 19 950

(51) Int. Cl.[7] ..... B25D 17/00

(52) U.S. Cl. ..... 173/201; 173/2; 173/20; 173/176

(58) Field of Search ..... 173/2, 4, 6, 20, 173/112, 201, 176; 324/207.22, 207.24

(56) References Cited

U.S. PATENT DOCUMENTS

| | | | | |
|---|---|---|---|---|
| 2,882,516 A | * | 4/1959 | De Neergaard | 360/110 |
| 3,464,503 A | | 9/1969 | Houck | |
| 4,109,475 A | * | 8/1978 | Schnell | 405/228 |
| 4,510,371 A | * | 4/1985 | Nakamura et al. | 219/121.85 |
| 5,365,168 A | * | 11/1994 | Reichl | 324/207.16 |
| 5,806,609 A | | 9/1998 | Stöck | |
| 6,253,460 B1 | | 7/2001 | Schmitz | |
| 6,367,337 B1 | * | 4/2002 | Schlabach | 73/862.331 |
| 6,396,260 B1 | * | 5/2002 | Reichl et al. | 324/207.25 |
| 6,411,081 B1 | * | 6/2002 | Spellman | 324/207.21 |
| 6,566,865 B2 | * | 5/2003 | Yasuda et al. | 324/207.2 |
| 6,611,790 B1 | * | 8/2003 | Reichl et al. | 702/163 |

FOREIGN PATENT DOCUMENTS

| | | |
|---|---|---|
| DE | 3210716 | 3/1982 |
| DE | 19956313 | 11/1999 |

* cited by examiner

*Primary Examiner*—Scott A. Smith
*Assistant Examiner*—Nathaniel Chukwurah
(74) *Attorney, Agent, or Firm*—Sidley Austin Brown & Wood, LLP

(57) ABSTRACT

A pneumatic percussive mechanism having an axially reciprocating percussive loaded percussion piston (2), wherein a non-contacting magnetic field sensitive sensor (3) is arranged radial thereto. The percussion piston (2) features at least externally ferromagnetic material and has a plurality of axially separated zones (4) of different magnetic permeability.

15 Claims, 2 Drawing Sheets

PNEUMATIC PERCUSSIVE MECHANISM

BACKGROUND OF THE INVENTION

Figure 1:
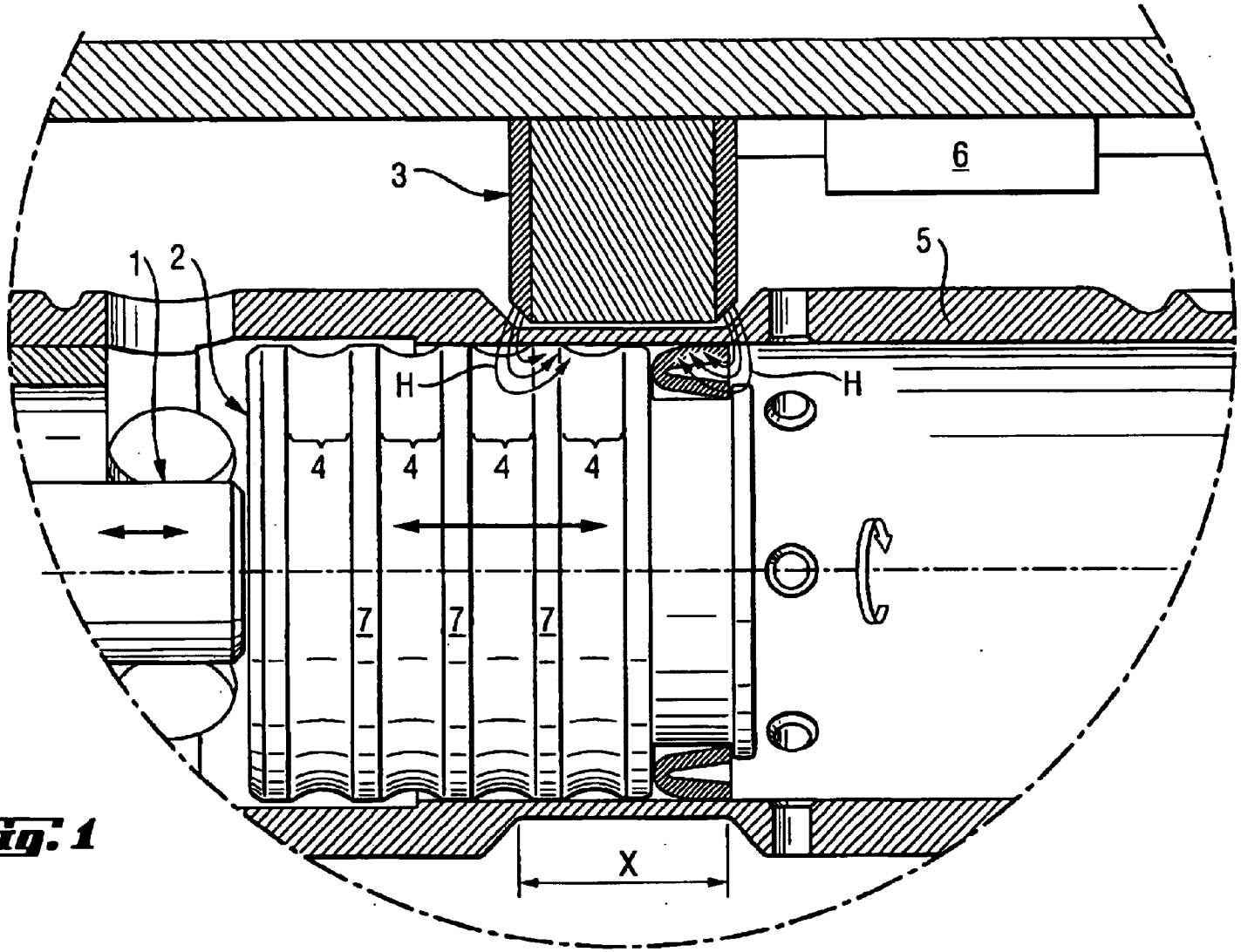

The invention relates to a pneumatic percussive mechanism with a percussion piston, in particular for an at least partially percussive hand machine or power tool, such as a drill or chisel hammer.

In a conventional at least partially percussive hand machine or power tool having a percussive mechanism, a percussion piston is moveable in a reciprocating onto an anvil and further onto the leading end of a tool, in a partially rotating guide, via a gas spring. By triggering the gas spring by a gas piston, on the one hand, and the interaction of the tool with the material to be worked on, on the other hand, the percussion piston is subject to a complex oscillation kinetics, whose steady-state oscillation status is dependent on the boundary constraints. Conventionally, the oscillation kinetics of the percussion piston are optimized with the other parts moved by simulation calculations and practical experiments and produced constructively.

According to U.S. Pat. No. 3,464,503, a piezoelectric sensor picks up the impacts of the percussive mechanism on the tool and with an electronic assessment system provides a controlled adaptation of the percussive mechanism behavior to the material to be worked. This type of percussive impulse measurement makes a comprehensive statement on the oscillation status of the percussion piston possible.

Moreover, DE 19956313 discloses that the position of a fluid-guided piston with a permanent magnet, in a working cylinder, is magnetically sensed by a sensor arranged external to the guide tube. This type of arrangement of a permanent magnet is suitable, preferably, for a slow piston, that is not percussive stressed.

In addition, according to DE 3210716 a high speed of a piston with several axially spaced annular zones of different permeability is magnetically sensed, using an externally radial, contact-less arranged magneto-resistive sensor, such that the change of the magnetic flux is sensed in a radial manner externally by the piston.

SUMMARY OF THE INVENTION

The object of the invention in a pneumatic percussive mechanism having a percussion piston is to at least partially sense its movement using measurement technology. A further aspect relates to the realization of a machine or power tool with control or regulation based on the measurement of the movement of the percussion piston.

The object is achieved according to the invention, wherein a pneumatic percussive mechanism having an axial back and forth moving, percussive actuated percussion piston comprises a magnetic field sensitive sensor arranged in a radial manner thereto, wherein the percussion piston has at least radial arranged external ferromagnetic material and several axially spaced zones of different magnetic permeability.

The movement of a radial reciprocating, percussive loaded percussion piston can be measured by the contact-less disposed magnetic field sensitive sensor, which optionally comprises a permanent magnet for generating the magnetic flux. The areas of different magnetic permeability in the percussion piston generate, at the output of the magnetic field sensitive sensor, an almost sinusoidal signal, whose amplitude is dependent on the distance of separation of the sensor to the percussion piston.

Advantageously, the magnetic field sensitive sensor is configured as a differentially switched, solid-state magnetic field sensor such as (Hall-Sensor, AMR (anisotropic magneto resistance)—sensor, GMR (giant magneto resistance)—sensor, MR (magneto resistance)—sensor, MI (magneto impedance)—sensor or as an inductive sensor comprising coil and flux guidance, which are available as standard components. Differential sensors are more insensitive to the radial play of the percussion piston since such sensors measure only the flux difference between two adjacent positions.

The geometry of these areas is dependent on the separation of the differentially connected magnetic field sensitive sensors, wherein advantageously the axial structure size of the areas corresponds at least to the air gap (the gap between the leading edge of the sensor and the piston). To increase the signal amplitudes somewhat larger structure widths are advantageous. The greatest possible axially separated areas on the piston are of advantage for the measurement of the speed trend of the percussion piston.

If, for example, only the zero-crossings are evaluated, then per period of the areas two items of information are obtained. If, in differentially connected sensors, the axial separation T of these two sensors is given (for example, $T_{sens}$=0.8 or 2.0 mm), then the period of the areas should aligned at the separation. The optimal period of the areas would then be the double of the separation of the sensors ($T_{area}$=1.6 mm or 4 mm). Moreover, it is further advantageous to place the sensors in a phase offset in the separation (2n+1)/2*T (n=0, 2, 1).

Advantageously, the areas of different magnetic permeability are configured by a plurality of axially separated, air filled radial grooves, which are technically simple to produce.

Advantageously, the radial grooves are 0.1–1.5 mm, optimally 0.8 mm deep and 0.5–5.0 mm, optimally 3.2 mm wide and form a permanent 0.1–3.0 mm, optimally 1.6 mm wide axial intermediate web, whereby large permeability differences occur at the time of movement past the sensor.

Advantageously, the sensor is arranged radial contact-less outside of an optionally rotating guide tube for the piston, whereby measurement through the guide tube is possible.

Advantageously, the guide tube is tapered in the axial measurement point area external radial to 0.1–2.0 mm, optimally 0.2 mm, whereby with a sufficiently bulge and bend resistant guide tube exerts a minimal influence on the measurement magnetic field radial external interpenetrating the percussion piston.

Advantageously, the sensor is connected to the computer unit, which determines a position and/or a speed from the temporal trend of the sensor signals, which corresponds to the permeability variations acquired by the sensor when the areas of different permeability pass by, whereby the inference of the steady-state oscillation status of the piston is possible. The computer unit uses for this purpose conventional methods of signal processing, such as curve fitting (partial cos fit, non-linear least squares fit), demodulation, Fourier transformation, power spectrum, filtering (autoregressive filter for spectral estimation) and frequency estimation methods (time—frequency analysis).

Advantageously the computer unit has classification means that can be selectively activated relative to the kinetics of the percussion piston, such as frequency filters, whereby different percussive conditions can be detected and can be classified, for example, in the event a tool encounters structural steel embedded in concrete.

Advantageously, an at least partially percussive machine or power tool with a pneumatic percussive mechanism with an axially reciprocating, percussive loaded percussion piston has a measurement arrangement of this type, whereby in a machine or power tool the kinetics of the percussion piston is at least partially directly measurable.

Advantageously, the computer unit addresses, in dependence on control means corresponding to the different percussive statuses of the percussion piston, the classification means, for example, for reducing the motor speed and/or the speed of the tool and/or interruption of regulation of the percussive drive and thus the percussive power.

Advantageously, the computer unit is connected to a target value memory for the optimal kinetics of the percussion piston and optional other boundary conditions such as percussive energy, number of impacts or strikes, speed, etc. for different materials to be worked, which is further advantageously organized as a multidimensional array, whereby the machine or power tool is automatically adaptable to an optional kinetics of the percussion piston and consequently adjustable to optimal cutting or reduction performance.

Advantageously, a no-load or blank strike can be determined from the sensor signal using the computer unit and the percussive mechanism can be deactivated via the corresponding control means, such as the electrical motor, whereby additional capture means for the piston, which require space and thus extend the machine tool, can be eliminated.

Advantageously, a percussive mechanism temperature can be calculated from the sensor signal using the computer unit and the percussive mechanism can be deactivated using the corresponding control means such as the electrical motor, whereby its service life can be increased.

BRIEF DESCRIPTION OF THE INVENTION

Figure 2:
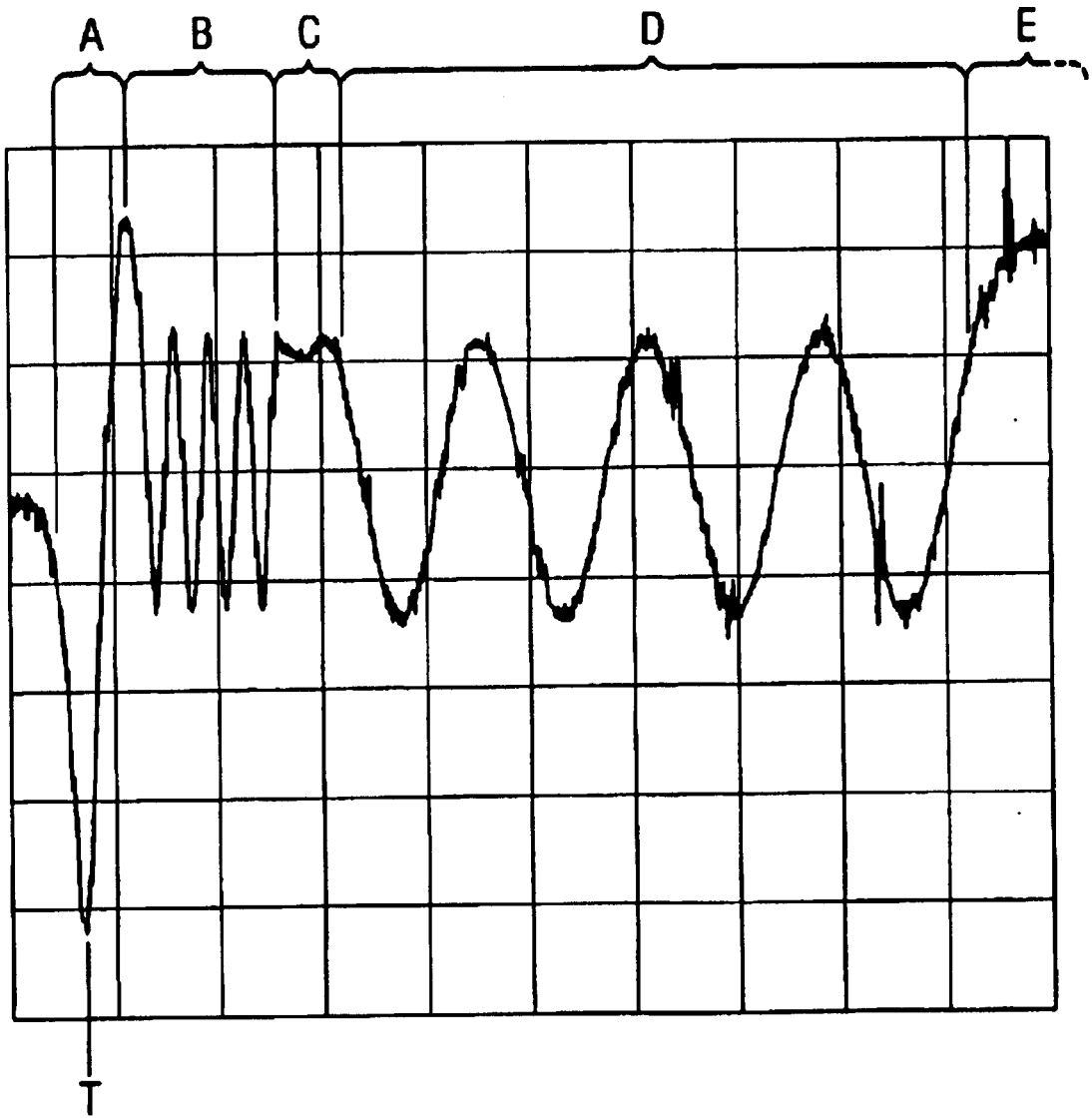

The exemplary embodiment of the invention will now be more completely described with reference to the drawings, wherein:

FIG. 1 shows a pneumatic percussive mechanism with a percussion piston according to the invention; and FIG. 2 shows a sensor signal according to the invention.

DETAILED DESCRIPTION OF THE INVENTION

According to FIG. 1, a pneumatic percussive mechanism with an axial reciprocating percussion piston 2 striking an anvil 1 has a magnetic field sensitive sensor 3 arranged contactless radial thereto, whereby the percussion piston 2 is comprised entirely of ferromagnetic material, i.e. steel, and has four axially spaced areas 4 of different magnetic permeability, i.e. air-filled radial grooves. The sensor 3 is configured as an internally differentially connected, solid-state magnetic field sensor and generates a measurement magnetic field H, whose magnetic flux penetrates into the radial edge zone of the percussion piston 2. The radial grooves of the percussion piston 2 are 0.8 mm deep and 3.2 mm wide and form a residual 1.6 mm wide axial intermediate web 7. The sensor 3 is fixed contact-less external to a rotating guide tube 5, which is made of non-ferromagnetic chrome steel, in an axial measurement point zone X that is radial external tapered to 0.2 mm. The sensor 3 is connected to a computer unit 6, i.e. a microcontroller, which is further connected with the motor electronics (not shown) of the electrical motor (also not shown).

FIG. 2 shows the sensor signal upon impact of the percussion piston during the steady-state operation. An essential feature of this sensor signal, is the substantial signal deviation, at the start, which is caused by the percussion piston itself entering the zone of the sensor. This signal deviation is always greater than the other oscillations because the flux change, due to the mass of the percussion piston itself, is larger than flux generated by the grooves. This characteristic signal deviation is used as the trigger signal T for data acquisition. From left to right the signal segments A–E of the sensor signal, which are selected by the computer unit and appropriately evaluated, are show. At signal segment A, the guide diameter of the percussion piston passes under the sensor, whereby the first stroke (downwards) is initiated, which serves as the trigger signal T. At signal segment B, the four axially separated grooves of the percussion piston pass under the sensor, whereby (four uniform) oscillation periods can be detected. At signal segment C, the percussion piston strikes the anvil, whereby the oscillation periods are demonstrably interrupted. At signal segment D, the percussion piston flies back slower, whereby (four uniform) oscillation periods of lower frequency can be detected. At signal segment E the guide diameter of the percussion piston starts again, now backwards, to pass under the sensor (last upward stroke).

Thus, for example, for a drill hammer advantageous application possibilities are provided for:

1. Underground Recognition

Depending on the subsurface, the percussion piston, on impact on the anvil or the leading end of the tool, will be reflected at different speeds. Using the rearward movement of the percussion piston, the subsurface type can be determined from the detected sensor signal using methods of signal processing (for example, using the calculation and arrangement of the subsurface-specific impact or percussive energy and number of strikes), using pattern recognition and fuzzy logic or using neuronal nets.

2. Measurement of Percussive Power, Status or Functionality of the Device:

The relationship of the speed of the percussion piston before impact on the anvil to the return speed is the strike number. This is the measure for the work output. When working a defined matrix, such as concrete, for example, the quality or the status of the drill hammer/tool can be checked using these parameters.

3. Measurement and Control of the Percussive Energy:

Using the speed of the percussion piston prior to impact, the percussive energy and the percussive work can be calculated by the computer unit in a conventional fashion. This is required as the measure for a work-dependent regulation of the drill hammer. Using this regulation, for example, using the speed of the electrical motor, the percussive energy can be continuously regulated by the computer unit. In addition, during the drilling operation, using matrix recognition with regulation of the percussive energy, an intelligent drill hammer is produced, which, for example, when boring a tile automatically detects a fragile ceramic and thus switches to "soft mode", in which the percussive energy, for example, is limited to 1.0 Joule. As soon as the tile is bore through and the matrix changes, the computer unit detects this and the percussive energy of the drill hammer is increased to the maximum percussive power. By virtue of this regulation, a bore hole with a smooth edge is possible without additional input of the operator.

4. Prevention of After-Strike:

The position of the percussion piston can be determined by the computer unit from the sensor signal. If the percussion piston penetrates forward beyond the strike position, the electrical motor can be cut-off or uncoupled and, in particular, in an SR (switched reluctance) motor, actively braked to prevent after-strike.

5. Temperature Measurement of the Percussive Mechanism:

A magnetic field sensitive sensor on the percussive mechanism makes a temperature measurement possible. The temperature of the percussive mechanism is an indicator of the lubrication and the current wear status of the percussive mechanism. The magnetic permeability of the majority of ferromagnetic materials decreases with increasing temperature. At the Curie point, it assumes the value of $\mu=1$. When measuring the percussion piston speed, the permeability change can be detected by the computer unit from the sensor signal, because the signal amplitude decreases with increasing temperature. In a temperature range of T=−10° C. to T=100° C. this is up to 30%. Using the regression of the signal amplitude the computer unit can infer the temperature of the percussive mechanism and, if necessary, take emergency action such as reduction of the speed of the electrical motor.

What is claimed is:

1. A pneumatic percussive mechanism with an axially loaded percussive percussion piston (2), comprising a magnetic field sensitive sensor (3) contactless radial arranged therewith, wherein the percussion piston (2) has at least radial external portions thereof formed of a ferromagnetic material and has a plurality of axially spaced zones (4) of different magnetic permeability.

2. The pneumatic percussive mechanism of claim 1, wherein the sensor (3) is one of a solid-state magnetic field sensor and an inductive sensor.

3. The pneumatic percussive mechanism of claim 1, wherein an axial structural dimension of the zones (4) corresponds at least to an effective air gap in the measurement magnetic field H.

4. The pneumatic percussive mechanism of claim 3, wherein the zones (4) have different magnetic permeability in a plurality of axially spaced, air-filled radial grooves.

5. The pneumatic percussive mechanism of claim 4, wherein the radial grooves are 0.1 to 1.5 mm deep and 0.5–5.0 mm wide and comprise a residual 0.1–3.0 mm wide axial intermediate web (7).

6. The pneumatic percussive mechanism of claim 1, wherein the sensor (3) is contact-less arranged radial external to an optionally rotatable guide tube (5) for the percussion piston (2).

7. The pneumatic percussive mechanism of claim 6, wherein the guide tube (5) is in an axial measurement zone (X) and externally radial tapered to 0.1–2.0 mm.

8. The pneumatic percussive mechanism of claim 6, wherein the guide tube (5) is at least in an axial measurement zone (X) of non-ferromagnetic material.

9. The pneumatic percussive mechanism according to claim 6, wherein the sensor (3) is connected to a computer unit (6) for determining at least one of a position and speed of the percussion piston (3) from a temporal trend of the sensor signal.

10. The pneumatic percussive mechanism of claim 9, wherein the computer unit (6) includes a classification means that is selectively activated relative to the kinetics of the percussion piston (2).

11. A machine or power tool having a pneumatic percussive mechanism with an axially reciprocating percussive percussion piston (2), wherein the pneumatic percussive mechanism comprises a magnetic field sensitive sensor (3) contact-less radial arranged therewith, wherein the percussion piston (2) at least radial externally comprises ferromagnetic material and the percussion piston (2) has a plurality of axially spaced zones (4) of different magnetic permeability and wherein the sensor (3) is connected to a computer unit (6) for determining at least one of a position and speed of the percussion piston (3) from a temporal trend of the sensor signal.

12. The machine or power tool of claim 11, wherein the computer unit (6) is connected to control means, which are addressable as a factor of the activated classification means.

13. The machine or power tool of claim 11, wherein the computer unit (6) is connected with a target value memory, wherein the target value memory contains data relative to the optimal kinetics of the percussion piston (2) and optional additional boundary conditions for different materials to be worked.

14. The machine or power tool of claim 13, wherein one of a no-load and blank strike of the percussion piston (2) is determined by the computer unit (6) from the sensor signal and the percussive mechanism is deactivated by appropriate control means.

15. The machine or power tool according to claim 13, wherein a percussive mechanism temperature is determined by the computer unit (6) from the sensor signal and the percussive mechanism is deactivated by appropriate control means.

* * * * *